US011192689B2

(12) United States Patent
Cai

(10) Patent No.: US 11,192,689 B2
(45) Date of Patent: Dec. 7, 2021

(54) STACKED STORAGE CONTAINER LATCH

(71) Applicant: Meridian International Co., Ltd., Shanghai (CN)

(72) Inventor: Shujun Cai, Shanghai (CN)

(73) Assignee: MERIDIAN INTERNATIONAL CO. LTD., Shanghai (CN)

( * ) Notice: Subject to any disclaimer, the term of this patent is extended or adjusted under 35 U.S.C. 154(b) by 110 days.

(21) Appl. No.: 16/846,878

(22) Filed: Apr. 13, 2020

(65) Prior Publication Data

US 2021/0155373 A1 May 27, 2021

(30) Foreign Application Priority Data

Nov. 27, 2019 (CN) ..... 201922118361.7

(51) Int. Cl.

| | |
|---|---|
| ***B65D 21/02*** | (2006.01) |
| ***B65D 67/02*** | (2006.01) |
| ***B65D 25/28*** | (2006.01) |
| ***B65D 71/50*** | (2006.01) |
| ***B65D 43/22*** | (2006.01) |

(52) U.S. Cl.

CPC ..... *B65D 21/0223* (2013.01); *B65D 21/0212* (2013.01); *B65D 21/0228* (2013.01); *B65D 43/22* (2013.01); *B65D 67/02* (2013.01); *B65D 25/2835* (2013.01); *B65D 71/502* (2013.01); *B65D 2525/283* (2013.01)

(58) Field of Classification Search

CPC ..... B65D 21/0224; B65D 21/0212; B65D 21/0228; B65D 21/0219; B65D 67/02; B65D 71/502; B65D 21/02; B65D 21/0209; B65D 21/17; B65D 21/0223

See application file for complete search history.

(56) References Cited

U.S. PATENT DOCUMENTS

| | | | | |
|---|---|---|---|---|
| 3,648,849 A * | 3/1972 | Harris | ..... | A47B 63/00 211/126.12 |
| 6,371,320 B2 * | 4/2002 | Sagol | ..... | B25H 3/00 206/501 |
| 6,889,838 B2 * | 5/2005 | Meier | ..... | B25H 3/021 206/508 |

(Continued)

FOREIGN PATENT DOCUMENTS

GN 206841966 U 1/2018

OTHER PUBLICATIONS

Australian Examination Report dated Feb. 19, 2022 from counterpart Australian Patent Application No. 2020202609.

*Primary Examiner* — Don M Anderson
*Assistant Examiner* — Jennifer Castriotta
(74) *Attorney, Agent, or Firm* — Shuttleworth & Ingersoll, PLC; Jason R. Sytsma

(57) ABSTRACT

At least one locking groove in a first storage container for receiving a sliding mechanism combined to a second storage container. The sliding mechanism selectively engages the locking groove of the first storage container to connect and hold the first storage container to the second storage container such that a portion of the sliding mechanism extends laterally away from the side surface of the container when the sliding mechanism is disengaged from the locking groove and wherein the portion of the sliding mechanism is coplanar with the side surface of the container when the sliding mechanism is engaged with the locking groove.

20 Claims, 7 Drawing Sheets

(56) References Cited

U.S. PATENT DOCUMENTS

| | | | | |
|---|---|---|---|---|
| 8,567,796 | B2 | 10/2013 | Bar-Erez et al. | |
| 8,936,258 | B2 | 1/2015 | Bar-Erez et al. | |
| 9,132,543 | B2 | 9/2015 | Bar-Erez et al. | |
| 9,566,990 | B2 | 2/2017 | Bar-Erez et al. | |
| 9,643,629 | B2 | 5/2017 | Bar-Erez et al. | |
| 10,106,180 | B2 | 10/2018 | Bar-Erez et al. | |
| 10,434,638 | B1 * | 10/2019 | Tsai | B65D 21/0228 |
| 2008/0121547 | A1 * | 5/2008 | Dur | B65D 21/0209 206/511 |
| 2012/0312812 | A1 | 12/2012 | Sosnovsky et al. | |
| 2016/0144500 | A1 * | 5/2016 | Chen | B65D 21/023 206/349 |
| 2017/0151972 | A1 | 6/2017 | Bar-Erez et al. | |
| 2019/0002004 | A1 | 1/2019 | Brunner | |

* cited by examiner

STACKED STORAGE CONTAINER LATCH

CROSS-REFERENCE TO RELATED APPLICATIONS

The present application claims the benefit of Chinese Patent Application No. 201922118361.7 filed Nov. 27, 2019, which is incorporated herein by reference.

TECHNICAL FIELD

The present invention relates to a container constructed and arranged to be connected to other containers.

BACKGROUND INFORMATION

Numerous container storage systems are known in the art. There is, however, a constant need in the industry to improve upon existing container storage systems by making them more efficient, easy to use, modular, and/or multifunctional.

SUMMARY

In accordance with one aspect of the present invention, a stackable storage system is provided. The system comprises of a first storage container configured and arranged to be selectively connected to a second storage container. The first storage container can comprise at least one locking groove for receiving a sliding mechanism combined to the second storage container. The sliding mechanism selectively engages the locking groove of the first storage container to connect and hold the first storage container to the second storage container such that a portion of the sliding mechanism extends laterally away from the side surface of the container when the sliding mechanism is disengaged from the locking groove and wherein the portion of the sliding mechanism is coplanar with the side surface of the container when the sliding mechanism is engaged with the locking groove.

In one implementation, the sliding mechanism further comprises of a slider that moves between the engaged and disengaged position with respect to the locking groove. The slider has a side surface that is perpendicular to the direction of travel of the slider between the engaged and disengaged position with respect to the locking groove and the side surface is coplanar with the side surface of the second storage container when the slider is engaged with the locking groove. The second storage container can further comprise of a slot in the side surface of the container with a support arm extending across the slot. The slider is engaged with the support arm to move between a locked position that corresponds to the engaged position of the locking groove and an unlocked position that corresponds to the disengaged position of the locking groove.

The support arm can further comprise of a first engaging groove for holding the slider in the unlocked position and a second engaging groove for holding the slider in the locked position. The first engaging groove is closer to the side surface of the container than the second engaging groove. The slider can further comprise of an elastic arm with an engaging protrusion that selectively engages the first engaging groove and the second engaging groove in the support arm.

The support arm can further comprise at least one block comprising a bevel. The slider further comprises of a recess with a sloped entry surface and a stopping surface for receiving the bevel and arresting outward movement of the slider wherein the stopping surface of the recess is parallel with the engaging protrusion of the elastic arm of the slider. The support arm and the slider can further comprise of a cooperating guide to constrain lateral movement of the slider with respect to the support arm. The cooperating guide can be a guiding rib on the support arm that cooperates with a guiding slot on the slider to constrain lateral movement of the slider with respect to the support arm.

The slot in the side surface of the container can be described by two laterally spaced apart side surfaces, a second side surface perpendicular thereto, and a bottom surface perpendicular thereto. The support arm is located across the slot between the two laterally spaced apart side surfaces and above the bottom surface and spaced apart from the second side surface for gripping and carrying the second storage container.

In one embodiment, the slot is in a side wall of the container portion of the container. In another implementation, the slot is in the lid of the second storage container.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
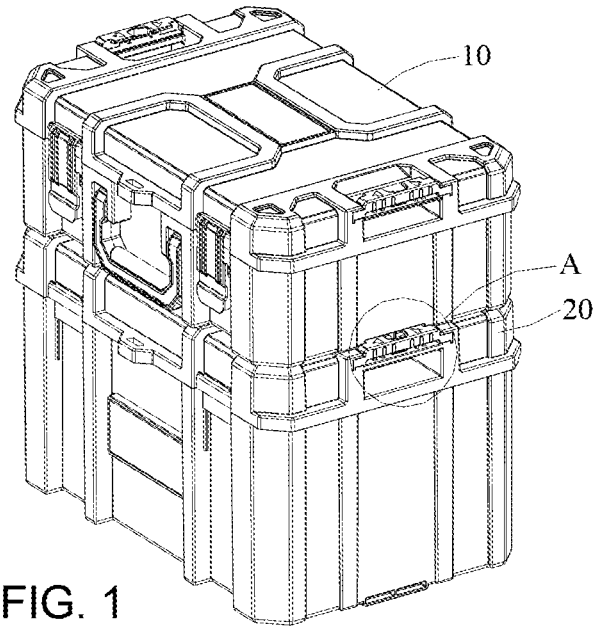
FIG. 1 is shows a side perspective view of a first storage container stacked on top of a second storage container and latched together according to an embodiment of this disclosure.
Figure 2:
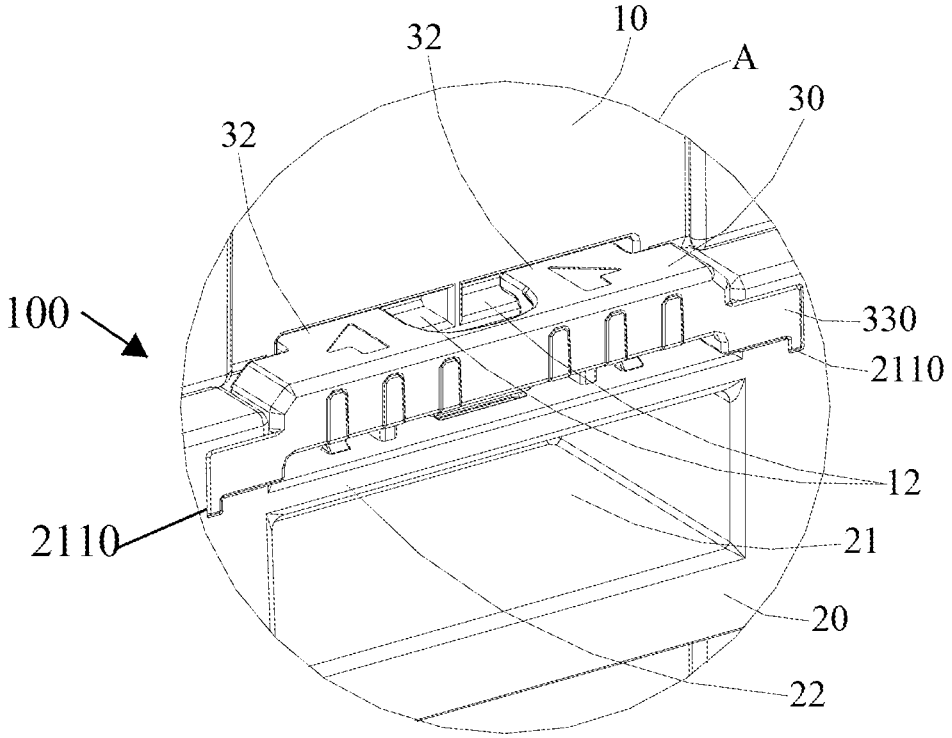
FIG. 2 shows an enlarged area A of FIG. 1.
Figure 3:
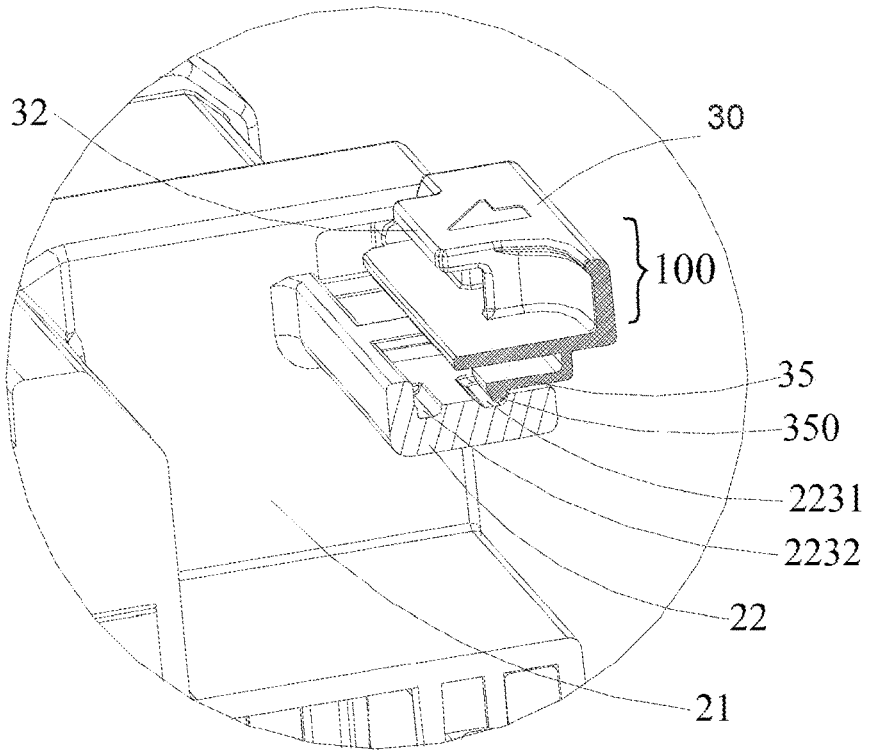
FIG. 3 shows a partial side cross-sectional view of the structure shown in enlarged area A of FIG. 2.

Referring to FIG. 1, shown is a first storage container 10 stacked on top of a second storage container 20 and latched together by a cooperating sliding mechanism 100. As will be appreciated, each first storage container 10 and second storage container 20 may be of the same or different configurations and be separated from each other for their respective particular uses. In the illustrated embodiment, first storage container 10 has a smaller volume than second storage container 20 for carrying articles of varying sizes.

Figure 4:
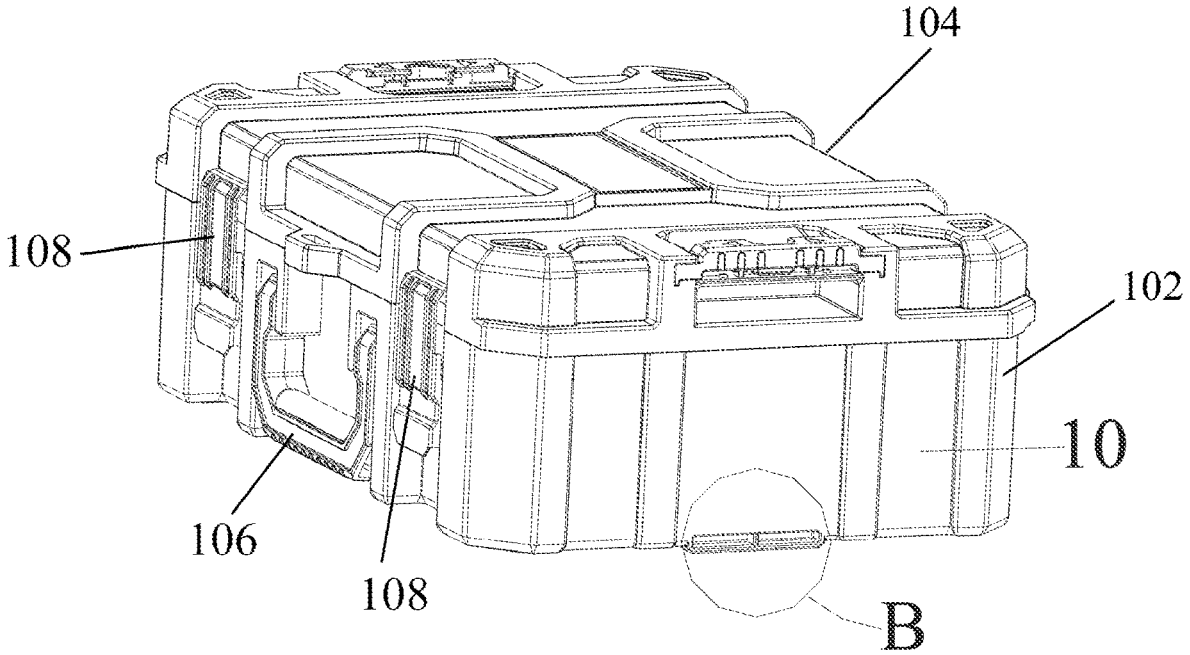
FIG. 4 shows a side perspective view of the first storage container of FIG. 1

First storage container 10, for example and referring to FIG. 4, may comprise a container portion 102 that contains opposing sides walls and a bottom portion defining an interior space. A privotally attached lid 104 is provided for ease of selective access to the interior of container portion 102. On the front side of first storage container 10, a carrying handle 106 is provided for ease of carrying. One or more lid latches 108 are provided to secure lid 104 to at least one of the sidewalls of container portion 102.

Figure 6:
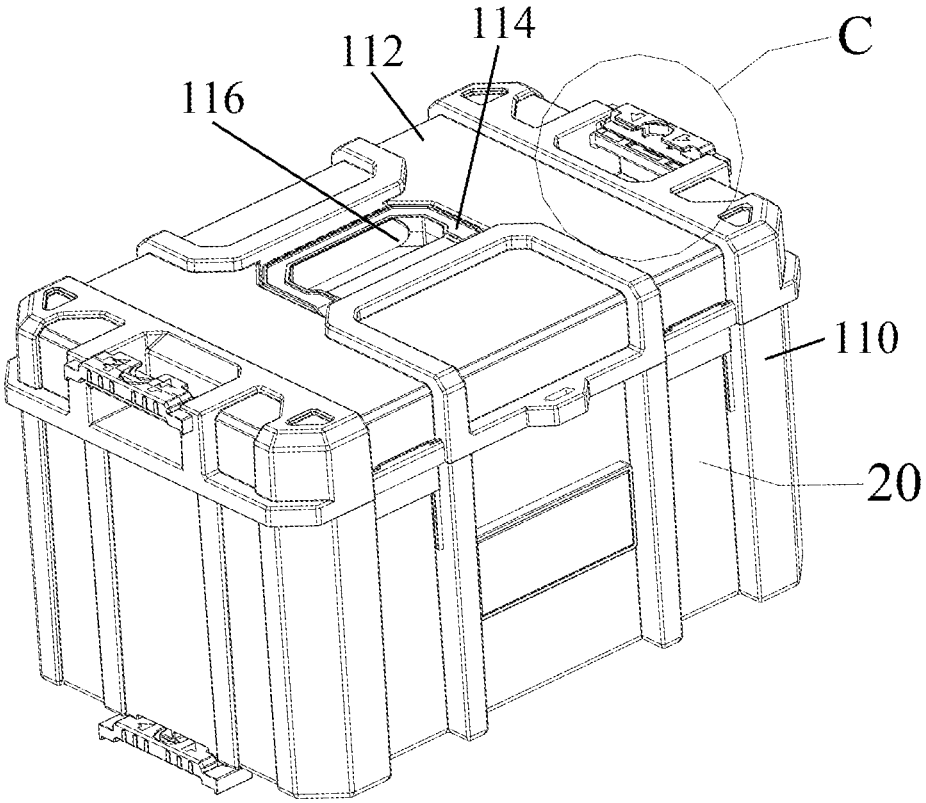
FIG. 6 shows a side perspective view of the second storage container of FIG. 1.

Second storage container 20, for example and referring to FIG. 6, similarly may comprise a container portion 110 that contains opposing sides walls and a bottom portion defining an interior space. A pivotally attached lid 112 is provided for ease of selective access to the interior of container portion 110. On the top side of lid 112, a carrying handle 114 is provided for ease of carrying. Noticeably, lid 112 pivots downward into a recess 116 in the top side of lid 112 when not in use. This allows for another storage container to be stacked on top without interference from handle 114. One or more lid latches can be provided to secure lid 112 to at least one of the sidewalls of container portion 110.

Referring to FIGS. 1-5, the present invention provides an interlocking structure, which includes first storage container 10, second storage container 20 and a slider 30. The first storage container 10 is stacked on the second storage container 20, and the slider 30 is slidably disposed on the second storage container 20 to secure the first storage container 10 to the second storage container 20. Considering the symmetrical structure of first storage container 10 and second storage container 20, the following only describes the interlocking sliding mechanism 100 on one side of the first storage container 10 and the second storage container 20 with it being understood that a similar structure can be provided on the other side.

Figure 5:
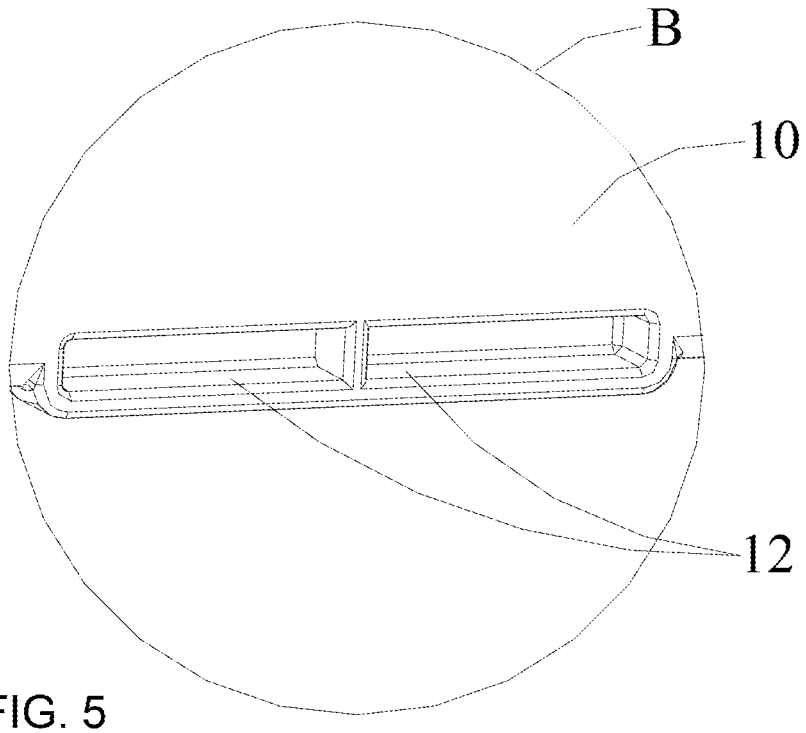
FIG. 5 shows an enlarged area B of FIG. 4.

Referring to FIG. 5, there are two spaced locking grooves 12 at the lower end of the outer side of the first storage container 10 to each receive an insertion portion 32 on slide 30 (shown in FIG. 10) for attaching first storage container 10 to second storage container 20. More specifically, with reference to FIGS. 3 and 9, the second storage container 20 is provided with a slot 21 which is located near the junction of the top surface and the side surface of lid 112 of second storage container 20. The slot 21 is described by two first side surfaces 211, a second side surface 212 and a bottom surface 213. A support arm 22 is located in and across the slot 21 between the two first side surfaces 211. The support arm 22 is located above the bottom surface 213 and is vertically connected to the two first side surfaces 211. And, the support arm 22 is located in front of the second surface 212 and is separated from the second side surface 212. The height of the two first side surfaces 211 extending upwards from the bottom surface 213 is higher than the height between the support arm 22 and the bottom surface 213. The two side surfaces 211 include a L-shaped guiding groove 2110 respectively, and those two guiding grooves 2110 extend towards the second side surface 212 to form a recessed hole, respectively.

The front surface of the support arm 22 is coplanar with the side surface of the second storage container 20, and the upper surface of the support arm 22 is provided with two spaced T-shaped guiding ribs 221, a reinforcing rib 222 connected perpendicularly to the guiding ribs 221, a first engaging groove 2231 and a second engaging groove 2232 located between the two guiding ribs 221, and two blocks 224 located outside two guiding ribs 221. The reinforcing rib 222 is located at the rear edge of the support arm 22 away from the front surface, and its two ends are respectively connected to the vertical first side surfaces 211. The first engaging groove 2231 and the second engaging groove 2232 are spaced apart and can be engaged with the slider 30 in the unlocked position and the locked position. Specifically, when the slider 30 is engaged with the second engaging groove 2232, the first storage container 10 and the second storage container 20 are locked, when the slider 30 is engaged with the first engaging groove 2231, the first storage container 10 and the second storage container 20 are unlocked. The two blocks 224 have a bevel 2240, the purpose of which will be discussed below.

Figure 7:
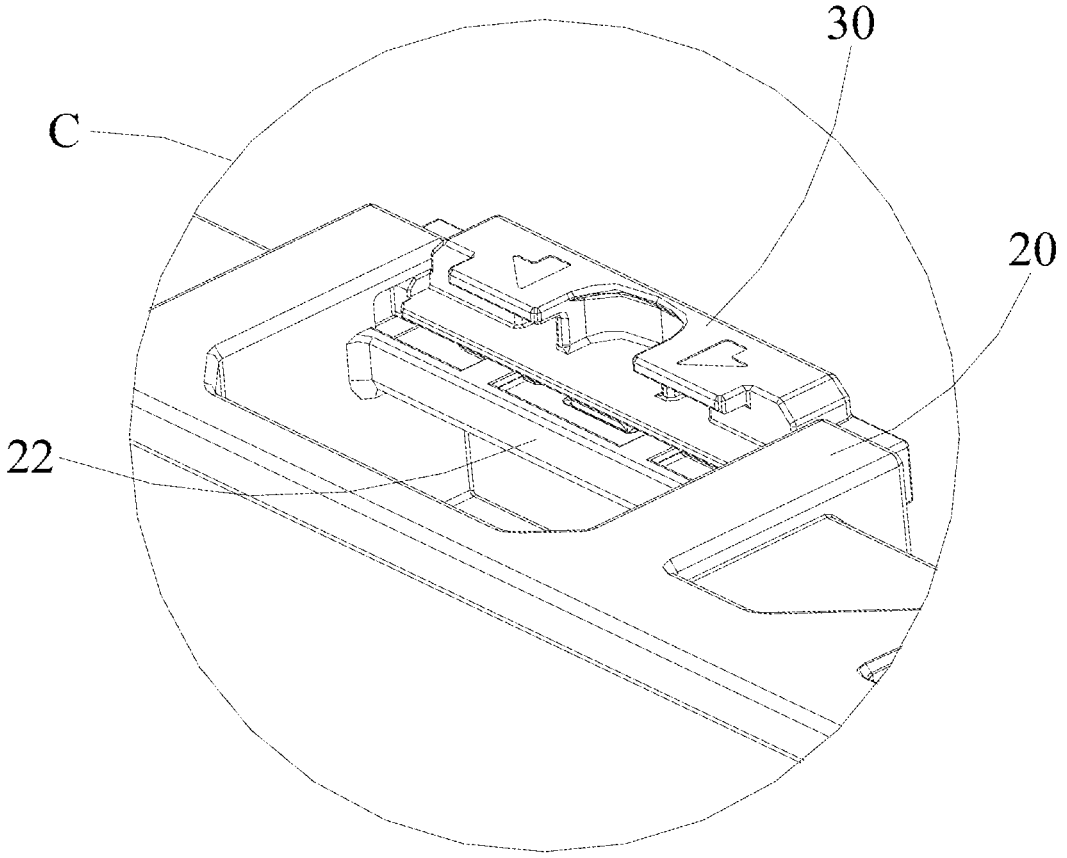
FIG. 7 shows an enlarged area C of FIG. 6.
Figure 8:
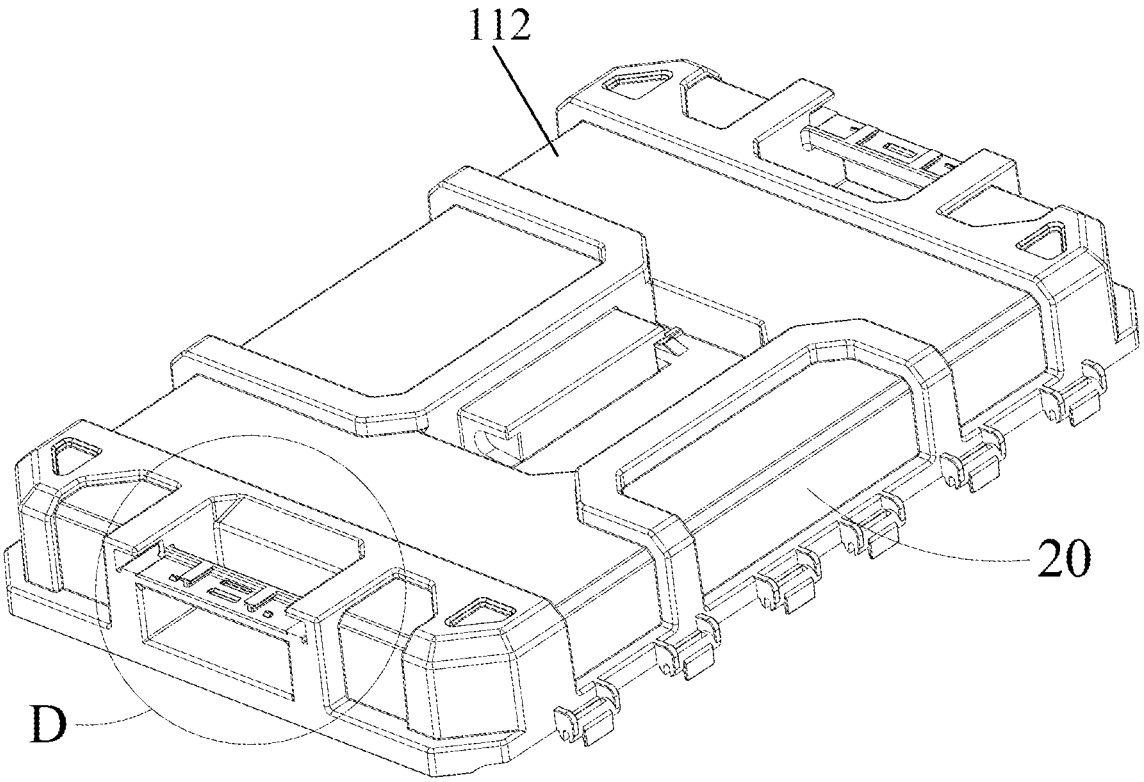
FIG. 8 shows a detached lid from the second storage container of FIG. 1.
Figure 10:
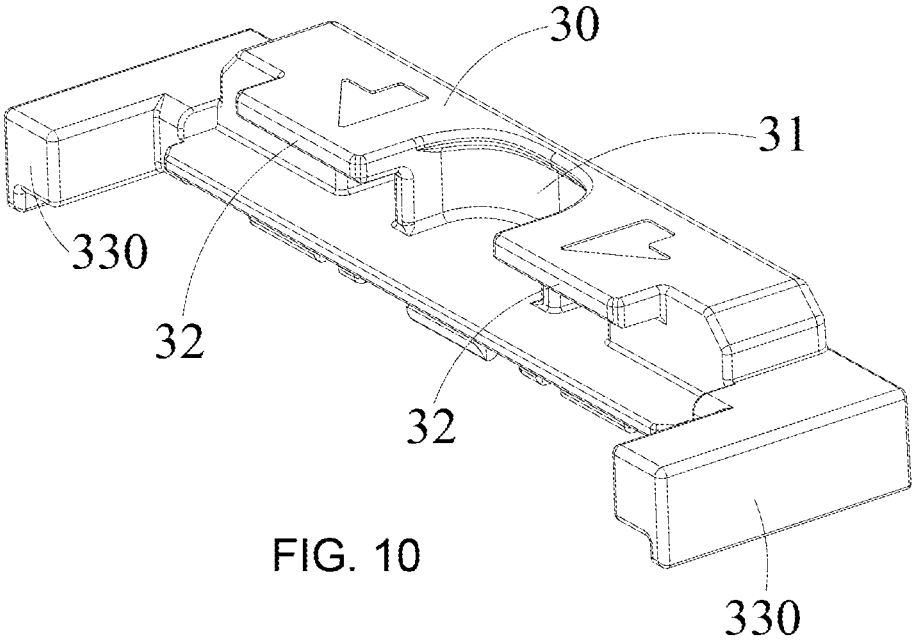
FIG. 10 shows a top perspective view of the slider.

Slider 30 will now be more particularly described with reference to FIGS. 7 and 10-11, the upper surface of the slider 30 is provided with a recessed portion 31 and two insertion portions 32. The recessed portion 31 is used to provide finger or tool access to push the slider 30. The two insertion portions 32 can insert into the locking grooves 12 (shown in FIG. 5), respectively to lock the first storage container 10 and the second storage container 20. Both ends of the slider 30 are provided with guide portions 330 that cooperate with the guiding grooves 2110 of the second storage container 20, so that the slider 30 can slide relative to the second storage container 20.

Figure 11:
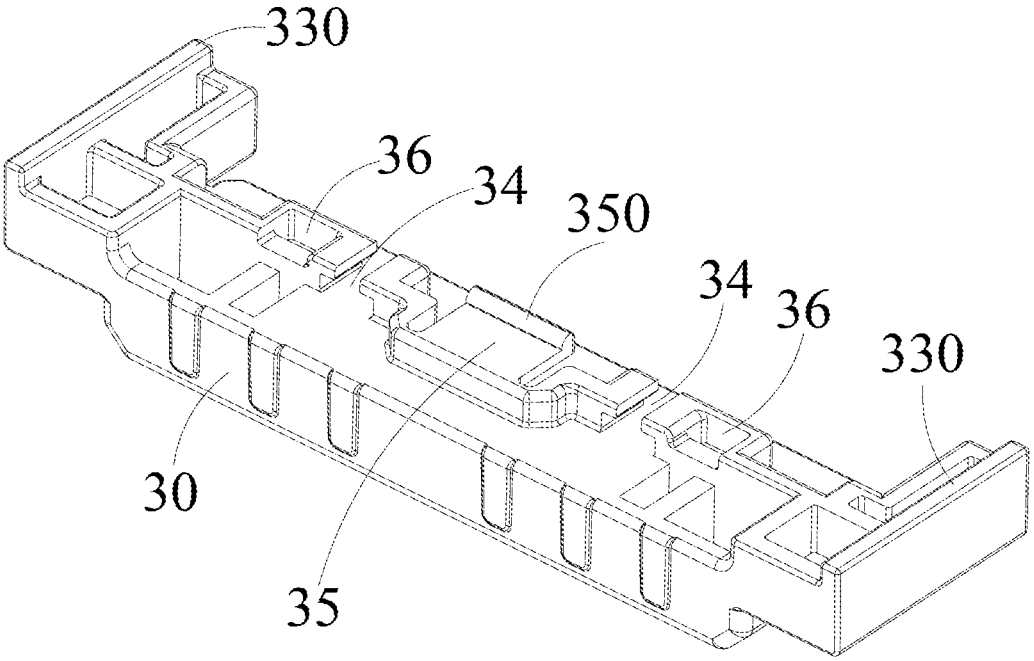
FIG. 11 shows a bottom perspective view of the slider of FIG. 10.

The lower surface of the slider 30, shown in FIG. 11, is provided with two spaced T-shaped guiding slots 34, an elastic arm 35 located between the two guiding slots 34, and two recesses 36 located outside the two guiding slots 34. The two guiding ribs 221 on support arm 22 can slide in the two guiding slots 34, respectively. This setting can provide guidance for the sliding of the slider 30, also provide a support and prevent the slider 30 from detaching from the second storage container 20. The elastic arm 35 can swing up and down elastically, and an engaging protrusion 350 is provided at the end of the elastic arm 35. The engaging protrusion 350 can be selectively engaged with the first engaging groove 2231 or the second engaging groove 2232 of the second storage container 20, which is convenient for setting the slider 30 to the second storage container 20 and also convenient for users to confirm if the slider 30 is slid to the locked position or the unlocked position. The two recesses 36 are used to receive the bevel 2240 of each of the two blocks 224 respectively. An opening is provided on one side of the recess 36 to allow the bevel 2240 of the block 224 to slide into place, and the opposite side is sealed to arrest its movement. When the slider 30 slides from the locked position to the unlocked position, the block 224 can abut against the sealed side of the recess 36, thus preventing the slider 30 from detaching from the second storage container 20. It is not difficult to understand that the recesses 36 can be set to other forms besides the recess, such as a rib is also effective, as long as it can resist the slider 30 and prevent it from sliding away from the second storage container 20.

Preferably, in this embodiment, the depth of the recessed holes formed by the two guiding grooves 2110 extending towards the second side surface 212 is greater than the length of the support arm 22 in this direction. Correspondingly, the length of the guide portion 330 is also greater than the length of the insertion portions 32, so that the slider 30 can be stably mounted on the second storage container 20. It can be understood that, in other embodiments, the depth of the recessed hole and the length of the guide portion 330 can be equal to or less than the length of the support arm 22, as long as it can ensure the installation and sliding of the slider 30 without detaching from the second storage container 20. Similarly, the length of the guiding rib 221 is required to ensure that the guiding rib 221 and the guiding slot 34 are not disengaged from each other regardless of whether the slider 30 is in the unlocked position or the locked position.

Figure 9:
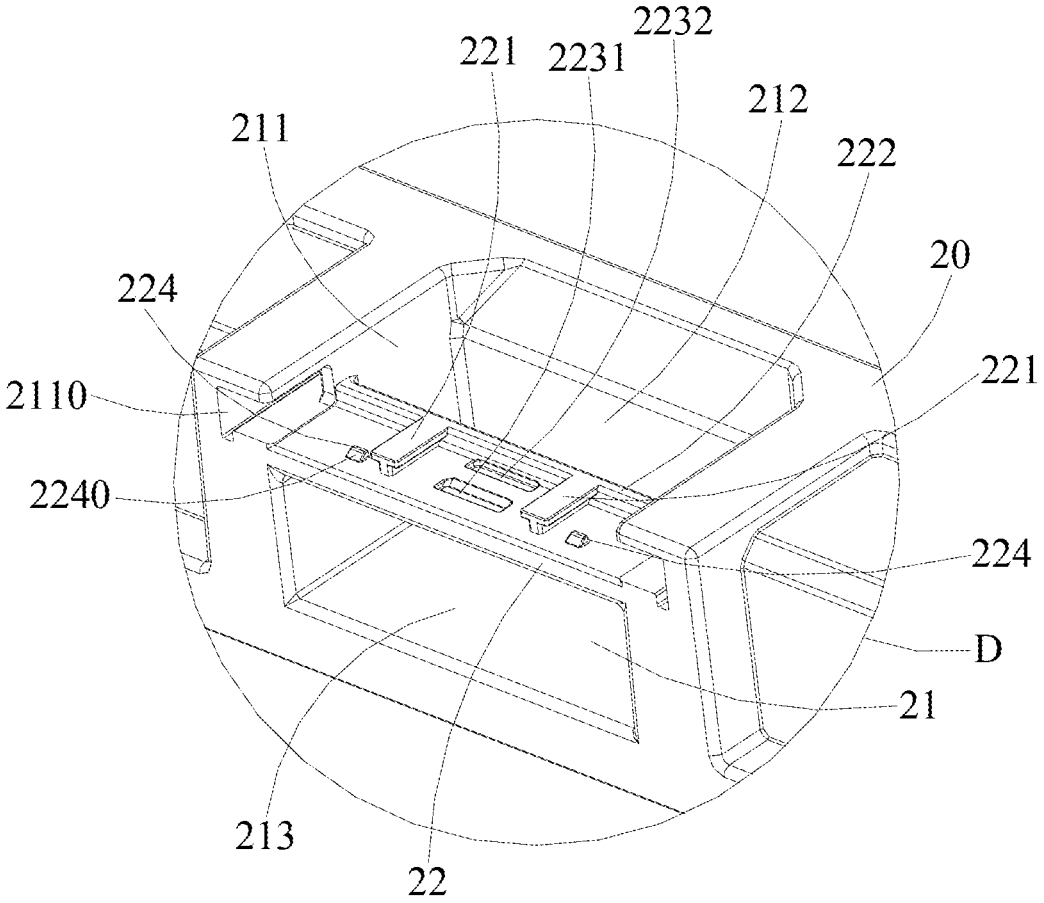
FIG. 9 shows an enlarged area D of FIG. 8.

It is worth noting that, in this embodiment, as shown in FIG. 9, the guiding grooves 2110 on the second storage container 20 are inverted L-shaped.

Correspondingly, the guide portions 330 on the slider 30 are also inverted L-shaped. In other embodiments, the guiding grooves 2110 and the guide portions 330 also can be designed to other shapes. Similarly, the guiding ribs 221 and the guiding slots 34 can be designed to other shapes besides T-shaped, such as wedge-shaped.

The quantities can be adjusted according to the different situations. In this embodiment, two pairs of the guiding rib 221 and its corresponding guiding slot 34, two pairs of the block 224 and its corresponding recess 36, two pairs of the insertion portion 32 and its corresponding locking groove 12, are provided. In other embodiments, other quantities and of projections and slots can be provided.

When the first storage container 10 and the second storage container 20 need to be connected to each other, the first storage container 10 is stacked on top of the second storage container 20, the user pushes the slider 30 so that the engaging protrusion 350 is disengaged with the first engaging groove 2231 and engaged with the second engaging groove 2232, and the insertion portions 32 are inserted into the locking grooves 12 of the first storage container 10 respectively to connect the first storage container 10 and the second storage container 20. At this time, the side surface of the second storage container 20 is coplanar with the outer side surface of the slider 30. When the first storage container 10 and the second storage container 20 need to be unlocked, the user needs to push the slider 30 in the reverse direction by using the recessed portion 31, so that the insertion portions 32 exit the locking grooves 12 of the first storage container 10, and the engaging protrusion 350 is disengaged with the second engaging groove 2232 and engaged with the first engaging groove 2231. In additional, the blocks 24 abut against the recesses 36 respectively to prevent the slider 30 from detaching from the second storage container 20. The first storage container 10 and the second storage container 20 also can be used separately. The engaging protrusion 350 on the slider 30 can be engaged with the second engaging groove 2232, so that the slider 30 will not protrude from the side surface of the second storage container 20. Besides, the gap between the support arm 22 (also the slider 30) and the second side surface 212, the bottom surface 213 can be inserted by fingers, which acts as a handle to move the storage container.

In this embodiment, both the first storage container 10 and the second storage container 20 include a cover, and the support arm 22, the slider 30 and the guiding grooves 2110 are provided at the side surface of the cover of the second storage container 20. In other embodiments, the first storage container 10 and/or the second storage container 20 can be other storage tools without a cover such as a basket.

For easy understanding, the storage system in this embodiment includes only two storage containers. It can be understood that, in other embodiments, three or more storage tools may be included in the system, and not limited to a storage container with cover. Also, the arrangements of the first storage container 10 and second storage container 20 can be switched with the second storage container 20 on top of first storage container 10. Each of the respective storage containers can have the necessary sliding mechanism 100 so that either can be on top.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

I claim:

1. A stackable storage system comprising:

a first storage container configured and arranged to be selectively connected to a second storage container, wherein the first storage container comprises of at least one locking groove and the second container comprises a sliding mechanism for selectively engaging the locking groove to connect and hold the first storage container to the second storage container, and wherein a portion of the sliding mechanism extends laterally away from a side surface of the second container when the sliding mechanism is disengaged from the locking groove and wherein the portion of the sliding mechanism is coplanar with the side surface of the second container when the sliding mechanism is engaged with the locking groove.

2. The stackable storage system of claim 1, wherein the sliding mechanism further comprises of a slider that moves between the engaged and disengaged position with respect to the locking groove.

3. The stackable storage system of claim 2, wherein the slider has a side surface that is perpendicular to the direction of travel of the slider between the engaged and disengaged position with respect to the locking groove and the side surface of the slider is coplanar with the side surface of the second container when the slider is engaged with the locking groove.

4. The stackable storage system of claim 3, wherein the second storage container further comprises of a slot in the side surface of the container with a support arm extending across the slot, wherein the slider is engaged with the support arm to move between a locked position that corresponds to the engaged position of the locking groove and an unlocked position that corresponds to the disengaged position of the locking groove.

5. The stackable storage system of claim 4, wherein the support arm further comprises of a first engaging groove for holding the slider in the unlocked position and a second engaging groove for holding the slider in the locked position.

6. The stackable storage system of claim 5, wherein the first engaging groove is closer to the side surface of the second container than the second engaging groove.

7. The stackable storage system of claim 6, wherein the slider further comprises of an elastic arm with an engaging protrusion that selectively engages the first engaging groove and the second engaging groove.

8. The stackable storage system of claim 7, wherein the support arm further comprises at least one block comprising a bevel, and the slider further comprises of a recess with a sloped entry surface and a stopping surface for receiving the bevel and arresting outward movement of the slider wherein the stopping surface of the recess is parallel with the engaging protrusion of the elastic arm of the slider.

9. The stackable storage system of claim 4, wherein the support arm and the slider further comprise a cooperating guide to constrain lateral movement of the slider with respect to the support arm.

10. The stackable storage system of claim 9, wherein the cooperating guide is a guiding rib on the support arm that cooperates with a guiding slot on the slider which to constrain lateral movement of the slider with respect to the support arm.

11. The stackable storage system of claim 4, wherein the second storage container further comprises of a guiding groove on each side of the support arm for receiving the slider and constraining lateral movement of the slider with respect to the support arm.

12. The stackable storage system of claim 4, wherein the slot in the side surface of the container is described by two laterally spaced apart side surfaces, a second side surface perpendicular thereto, and a bottom surface perpendicular thereto, wherein the support arm is located across the slot between the two laterally spaced apart side surfaces and above the bottom surface and spaced apart from the second side surface for gripping and carrying the second storage container.

13. The stackable storage system of claim 12, wherein the slot is in a lid of the second storage container.

14. A stackable storage container comprising:

a second storage container configured and arranged to be selectively connected to a locking groove of a first storage container, wherein the second container comprises a sliding mechanism for selectively engaging the locking groove of the first storage container to connect and hold the first storage container to the second storage container, and wherein a portion of the sliding mechanism extends laterally away from a side surface of the second container when the sliding mechanism is disengaged from the locking groove and wherein the portion of the sliding mechanism is coplanar with the side surface of the second container when the sliding mechanism is engaged with the locking groove.

15. The storage container of claim 14, wherein the sliding mechanism further comprises of a slider that moves between the engaged and disengaged position with respect to the locking groove, wherein the slider has a side surface that is perpendicular to the direction of travel of the slider between the engaged and disengaged position with respect to the locking groove and the side surface of the slider is coplanar with the side surface of the second storage container when the slider is engaged with the locking groove, and wherein the second storage container further comprises of a slot in the side surface of the container with a support arm extending across the slot, wherein the slider is engaged with the support arm to move between a locked position that corresponds to the engaged position of the locking groove and an unlocked position that corresponds to the disengaged position of the locking groove.

16. The storage system of claim 15, wherein the support arm further comprises of a first engaging groove for holding the slider in the unlocked position and a second engaging groove for holding the slider in the locked position, wherein the first engaging groove is closer to the side surface of the second container than the second engaging groove, and wherein the slider further comprises of an elastic arm with an engaging protrusion that selectively engages the first engaging groove and the second engaging groove.

17. The storage system of claim 16, wherein the support arm further comprises at least one block comprising a bevel, and the slider further comprises of a recess with a sloped entry surface and a stopping surface for receiving the bevel and arresting outward movement of the slider wherein the stopping surface of the recess is parallel with the engaging protrusion of the elastic arm of the slider.

18. The storage system of claim 17, wherein the support arm and the slider further comprise a cooperating guide to constrain lateral movement of the slider with respect to the support arm, wherein the cooperating guide is a guiding rib on the support arm that cooperates with a guiding slot on the slider which to constrain lateral movement of the slider with respect to the support arm.

19. The storage system of claim 15, wherein the slot in the side surface of the container is described by two laterally spaced apart side surfaces, a second side surface perpendicular thereto, and a bottom surface perpendicular thereto, wherein the support arm is located across the slot between the two laterally spaced apart side surfaces and above the bottom surface and spaced apart from the second side surface for gripping and carrying the second storage container.

20. The storage system of claim 15, wherein the slot is in a lid of the second storage container.

* * * * *